US007015439B1

(12) United States Patent
Thomas et al.

(10) Patent No.: US 7,015,439 B1
(45) Date of Patent: Mar. 21, 2006

(54) METHOD AND SYSTEM FOR CONTROL OF ON-SITE INDUCTION HEATING

(75) Inventors: Jeffrey R. Thomas, Appleton, WI (US); Randall G. Baxter, Black Creek, WI (US); Mark A. Ulrich, New London, WI (US); Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 431 days.

(21) Appl. No.: 09/995,165

(22) Filed: Nov. 26, 2001

(51) Int. Cl.
*H05B 6/06* (2006.01)

(52) U.S. Cl. ..... 219/667; 219/663; 266/87; 266/129

(58) Field of Classification Search ..... 219/667, 219/665, 663, 635; 266/80, 87, 96, 99, 129
See application file for complete search history.

(56) References Cited

U.S. PATENT DOCUMENTS

| | | | | | |
|---|---|---|---|---|---|
| 2,457,843 | A | | 1/1949 | Strickland, Jr. | 174/47 |
| 2,483,301 | A | | 9/1949 | Roberds | 174/15 |
| 2,817,066 | A | | 12/1957 | Scarpa | 336/84 |
| 2,988,804 | A | | 6/1961 | Tibbetts | 29/155.57 |
| 3,022,368 | A | | 2/1962 | Miller | 174/15 |
| 3,492,453 | A | | 1/1970 | Hurst | 219/10.49 |
| 3,535,597 | A | | 10/1970 | Kendrick | 317/155.5 |
| 3,603,130 | A | * | 9/1971 | Ruget | 72/322 |
| 3,620,294 | A | * | 11/1971 | Hetzel et al. | 164/155.4 |
| 3,637,985 | A | * | 1/1972 | Stacey | 219/490 |
| 3,764,725 | A | | 10/1973 | Kafka | 174/15 |
| 3,946,349 | A | | 3/1976 | Haldeman, III | 336/62 |
| 4,317,979 | A | | 3/1982 | Frank et al. | 219/10.77 |
| 4,339,645 | A | | 7/1982 | Miller | 219/10.49 |
| 4,355,222 | A | | 10/1982 | Geithman et al. | 219/10.57 |
| 4,392,040 | A | | 7/1983 | Rand et al. | 219/10.71 |
| 4,527,032 | A | | 7/1985 | Young et al. | 219/10.61 |
| 4,527,550 | A | | 7/1985 | Ruggera et al. | 128/1.5 |
| 4,549,056 | A | | 10/1985 | Okatsuka et al. | 219/10.77 |
| 4,578,552 | A | | 3/1986 | Mortimer | 219/10.41 |
| 4,606,529 | A | * | 8/1986 | Tooch | 266/80 |
| 4,761,528 | A | | 8/1988 | Caillaut et al. | 219/10.491 |
| 4,780,588 | A | * | 10/1988 | Edamura | 219/714 |
| 4,794,220 | A | | 12/1988 | Sekiya | 219/10.491 |
| 4,845,332 | A | * | 7/1989 | Jancosek et al. | 219/645 |
| 4,900,885 | A | | 2/1990 | Inumada | 219/10.55 B |
| 4,942,279 | A | | 7/1990 | Ikeda | 219/10.75 |
| 4,963,694 | A | | 10/1990 | Alexion et al. | 174/15.6 |
| 4,975,672 | A | | 12/1990 | McLyman | 336/198 |
| 5,004,865 | A | | 4/1991 | Krupnicki | 174/15.7 |
| 5,033,720 | A | * | 7/1991 | Chen | 266/79 |

(Continued)

OTHER PUBLICATIONS

Manning U.S.A. Brochure—"Induction Bolt Heating Services".

(Continued)

*Primary Examiner*—Philip H. Leung
(74) *Attorney, Agent, or Firm*—Fletcher Yoder

(57) ABSTRACT

A workpiece heating system having an induction heating power source and a controller. The controller is operable to control the operation of the power source according to programming instructions received from a user. The controller enables a user to establish a sequence of inductive heating operations to be performed automatically by the induction heating system from among a selection of inductive heating operations. A temperature feedback device may be included to provide the controller with the workpiece temperature. A data recorder may be provided to receive and record the workpiece temperature.

28 Claims, 9 Drawing Sheets

U.S. PATENT DOCUMENTS

| | | | | | |
|---|---|---|---|---|---|
| 5,101,086 | A | | 3/1992 | Dion et al. | 219/10.491 |
| 5,113,049 | A | | 5/1992 | Border et al. | 219/10.79 |
| 5,185,513 | A | | 2/1993 | Pacileo | 219/497 |
| 5,266,764 | A | * | 11/1993 | Fox et al. | 219/672 |
| 5,313,037 | A | | 5/1994 | Hansen et al. | 219/632 |
| 5,343,023 | A | | 8/1994 | Geissler | 219/661 |
| 5,385,200 | A | * | 1/1995 | Yuki et al. | 164/457 |
| 5,391,862 | A | * | 2/1995 | Amateau et al. | 219/667 |
| 5,461,215 | A | | 10/1995 | Haldeman | 219/677 |
| 5,504,309 | A | | 4/1996 | Geissler | 219/663 |
| 5,708,253 | A | | 1/1998 | Bloch et al. | 219/130.01 |
| 5,746,114 | A | * | 5/1998 | Harris | 99/331 |
| 5,770,838 | A | * | 6/1998 | Rohrbaugh et al. | 219/645 |
| 6,043,471 | A | | 3/2000 | Wiseman et al. | 219/662 |
| 6,124,581 | A | | 9/2000 | Ulrich | 219/665 |
| 6,229,126 | B1 | | 5/2001 | Ulrich et al. | 219/635 |
| 6,265,701 | B1 | | 7/2001 | Bickel et al. | 219/617 |
| 6,316,755 | B1 | | 11/2001 | Ulrich | 219/665 |
| 6,346,690 | B1 | | 2/2002 | Ulrich et al. | 219/635 |

OTHER PUBLICATIONS

Superheat Services, Inc. Brochure—"On Site Heat Treatment Specialists".

400 Cycle Induction Heating with proportional control for Preheating and Stress Relieving or Welding Joints, Hobart Brothers Co.

Installation, Operation, and Maintenance for High Frequency Induction Heaters, Hobart Brothers Co.

* cited by examiner

METHOD AND SYSTEM FOR CONTROL OF ON-SITE INDUCTION HEATING

FIELD OF THE INVENTION

The present invention relates generally to induction heating, and particularly to a method and apparatus for controlling the induction heating of a workpiece at a worksite.

BACKGROUND OF THE INVENTION

Induction heating is a method of heating a workpiece. Induction heating involves applying an AC electric signal to a conductor adapted to produce a magnetic field, such as a loop or coil. The alternating current in the conductor produces a varying magnetic flux. The conductor is placed near a metallic object to be heated so that the magnetic field passes through the object. Electrical currents are induced in the metal by the magnetic flux. The metal is heated by the flow of electricity induced in the metal by the magnetic field.

Typically, induction heating is performed by a large fixed system located in a manufacturing facility, such as a foundry. Systems have been developed for performing induction heating on location at a worksite. However, these systems are very limited in their abilities. For example, existing induction heating systems for use on-site are not designed to perform temperature profiling of a workpiece, as is required for certain induction heating operations, such as post-weld stress-relieving. Temperature profiling is a process whereby a number of heating and/or cooling operations are performed on a workpiece over a period of time. The workpiece may be heated at a specific rate to a specific temperature, maintained at that temperature for a specified period of time, and then lowered at a specific rate to a lower temperature. Heat may still be provided to the workpiece during cooling so as to control the rate of temperature decrease. Materials of different size may require the induction system to operate at different temperatures and rates of temperature change. In addition, different operations may require that a workpiece undergo an entirely different temperature profiles.

There is a need therefore for an induction heating system that avoids the problems associated with current onsite induction heating systems. Specifically, there is a need for an on-site induction heating system that is operable to be programmed to perform a variety of induction heating operations including post-weld heating, stress-relieving, annealing, surface hardening, and other heat treating applications.

SUMMARY OF THE INVENTION

The present technique provides novel inductive heating components, systems, and methods designed to respond to such needs. According to one aspect of the present technique, an induction heating system is provided that comprises a power source, a controller, and a temperature feedback device. The temperature feedback device is operable to provide the controller with the temperature of the workpiece. The power source is operable to be transported to a worksite to provide a varying magnetic field to inductively heat a workpiece. The controller is operable to receive programming instructions to maintain temperature or to change workpiece temperature at a desired rate of temperature change. The controller also is operable to control operation of the power source automatically so as to inductively heat the workpiece at the desired rate of temperature change.

According to another aspect of the present technique, an induction heating system is featured that comprises an induction heating power source, a temperature feedback device, a controller, and a data recorder is featured. The temperature feedback device is operable to provide the system with workpiece temperature data. The controller is operable to control operation of the power source automatically in response to programming instructions and workpiece temperature data received from the temperature feedback device. The data recorder is operable to receive and record the workpiece temperature data.

According to another aspect of the present technique, a system controller for an induction heating system is featured. The system controller has a control unit and a user interface. The control unit is operable to control operation of an inductive heating power source automatically in response to programming instructions. The user interface enables a user to provide the programming instructions to the control unit. In addition, the user interface enables a user to establish a sequence of inductive heating operations from a selection of inductive heating operations to be performed automatically by the induction heating system.

According to still another aspect of the present invention, a component heating system is featured. The component heating system has a power source that is electrically coupled to an induction heating device. The component heating system also has a system controller that has a control unit and a user interface. The control unit is operable to control the operation of a power source automatically, in response to programming instructions. The user interface enables a user to provide the programming instructions to the control unit. The user interface enables a user to establish a sequence of heating operations by selecting specific heating operations from among a plurality of different heating operations that may be performed automatically by the component heating system.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
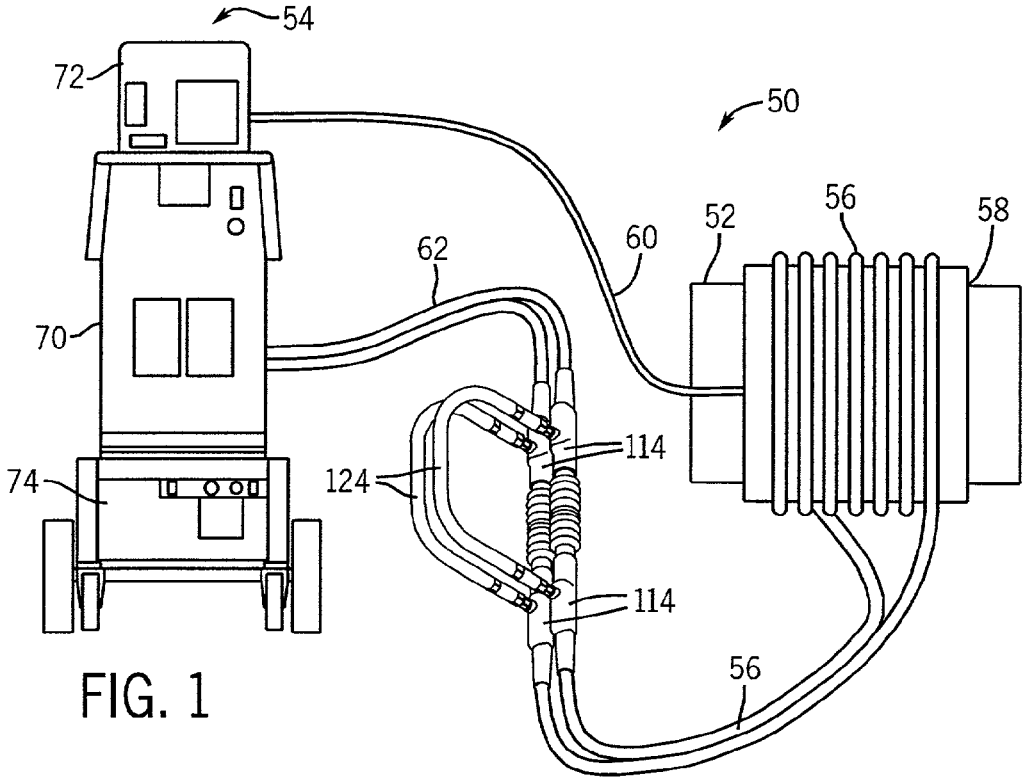
FIG. 1 is an induction heating system, according to an exemplary embodiment of the present technique.

Referring generally to FIGS. 1–5, an induction heating system 50 for applying heat to a workpiece 52 is illustrated. In the illustrated embodiment, the workpiece 52 is a circular pipe. However, the workpiece 52 may have a myriad of shapes and compositions. As best illustrated in FIG. 1, the induction heating system 50 comprises a power system 54, a flexible fluid-cooled induction heating cable 56, an insulation blanket 58, at least one temperature feedback device 60, and an extension cable 62. The extension cable 62 is used to extend the effective distance of the fluid-cooled induction heating cable 56 from the power system 54. The power system 54 produces a flow of AC current through the extension cable 62 and fluid-cooled induction heating cable 56. Additionally, the power system provides a flow of cooling fluid through the extension cable 62 and fluid-cooled induction heating cable 56. In FIG. 1, the fluid-cooled induction heating cable 56 has been wrapped around the workpiece 52 several times to form a series of loops.

Figure 2:
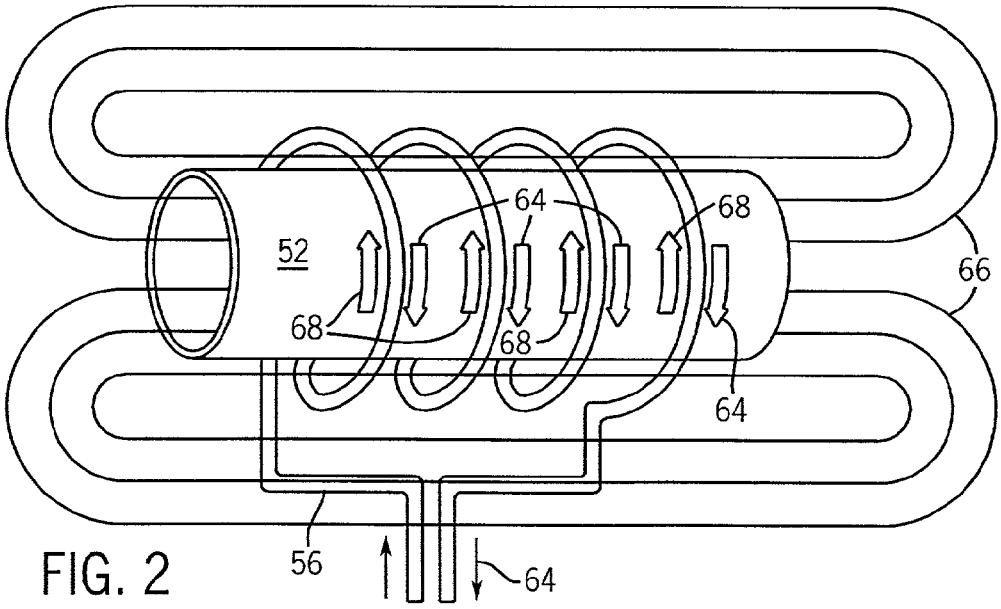
FIG. 2 is a diagram of the process of inducing heat in a workpiece using an induction heating system, according to an exemplary embodiment of the present technique.

As best illustrated in FIG. 2, the AC current 64 flowing through the fluid-cooled induction heating cable 56 produces a magnetic field 66. The magnetic field 66, in turn, induces a flow of current 68 in the workpiece 52. The induced current 68 produces heat in the workpiece 52. Referring again to FIG. 1, the insulation blanket 58 forms a barrier to reduce the loss of heat from the workpiece 52 and to protect the fluid-cooled induction heating cable 56 from heat damage. The fluid flowing through the fluid-cooled induction heating cable 56 also acts to protect the fluid-cooled induction heating cable 56 from heat damage due to the temperature of the workpiece 52 and electrical current flowing through the fluid-cooled induction heating cable. The temperature feedback device 60 provides the power system 54 with temperature information from the workpiece 52.

Referring again to FIG. 1, in the illustrated embodiment, the power system 54 comprises a power source 70, a controller 72, and a cooling unit 74. The power source 70 produces the AC current that flows through the fluid-cooled induction heating cable 56. In the illustrated embodiment, the controller 72 controls the operation of the power source 70 in response to programming instructions and the workpiece temperature information received from the temperature feedback device 60. The cooling unit 74 is operable to provide a flow of cooling fluid through the fluid-cooled induction heating cable 56 to remove heat from the fluid-cooled induction heating cable 56.

Figure 3:
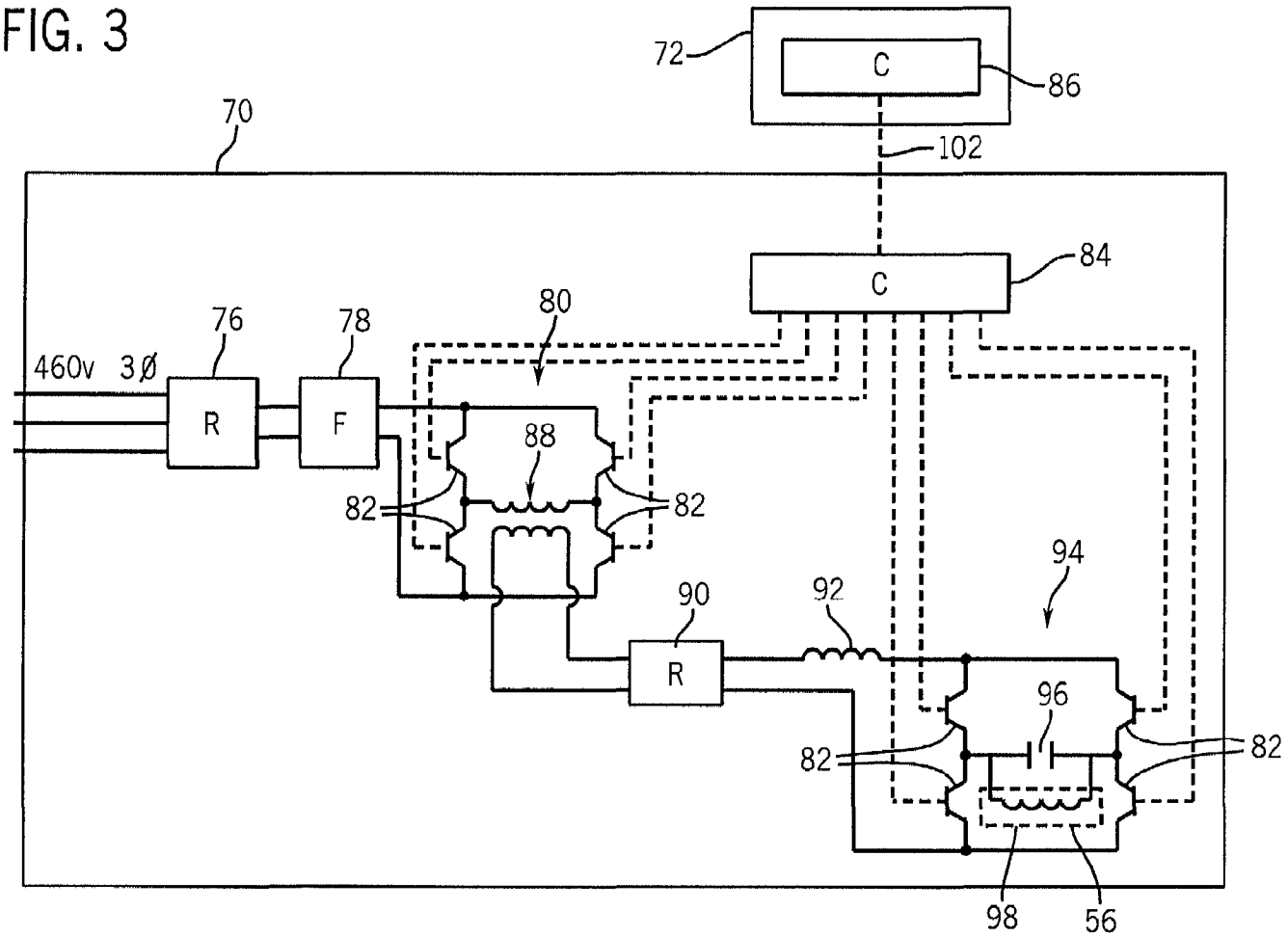
FIG. 3 is an electrical schematic diagram of an induction heating system, according to an exemplary embodiment of the present technique.

Referring generally to FIG. 3, an electrical schematic of a portion of the system 50 is illustrated. In the illustrated embodiment, 460 Volt, 3-phase AC input power is coupled to the power source 70. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBTs. Additionally, in the illustrated embodiment, a controller board 84 housed within the power source 70 controls the electronic switches 82. Control circuitry 86 within the controller 72 in turn, provides signals to control the controller board 84 in the power source 70.

A step-down transformer 88 is used to couple the AC output from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 steers the DC output current into high-frequency AC signals. A capacitor 96 is coupled in parallel with the fluid-cooled induction heating cable 56 across the output of the second inverter circuit 94. The fluid-cooled induction heating cable 56, represented schematically as an inductor 98, and capacitor 96 form a resonant tank circuit. The capacitance and inductance of the resonant tank circuit establishes the frequency of the AC current flowing through the fluid-cooled induction heating cable 56. The inductance of the fluid-cooled induction heating cable 56 is influenced by the number of turns of the heating cable 56 around the workpiece 52. The current flowing through the fluid-cooled induction heating cable 56 produces a magnetic field that induces current flow, and thus heat, in the workpiece 52.

Figure 4:
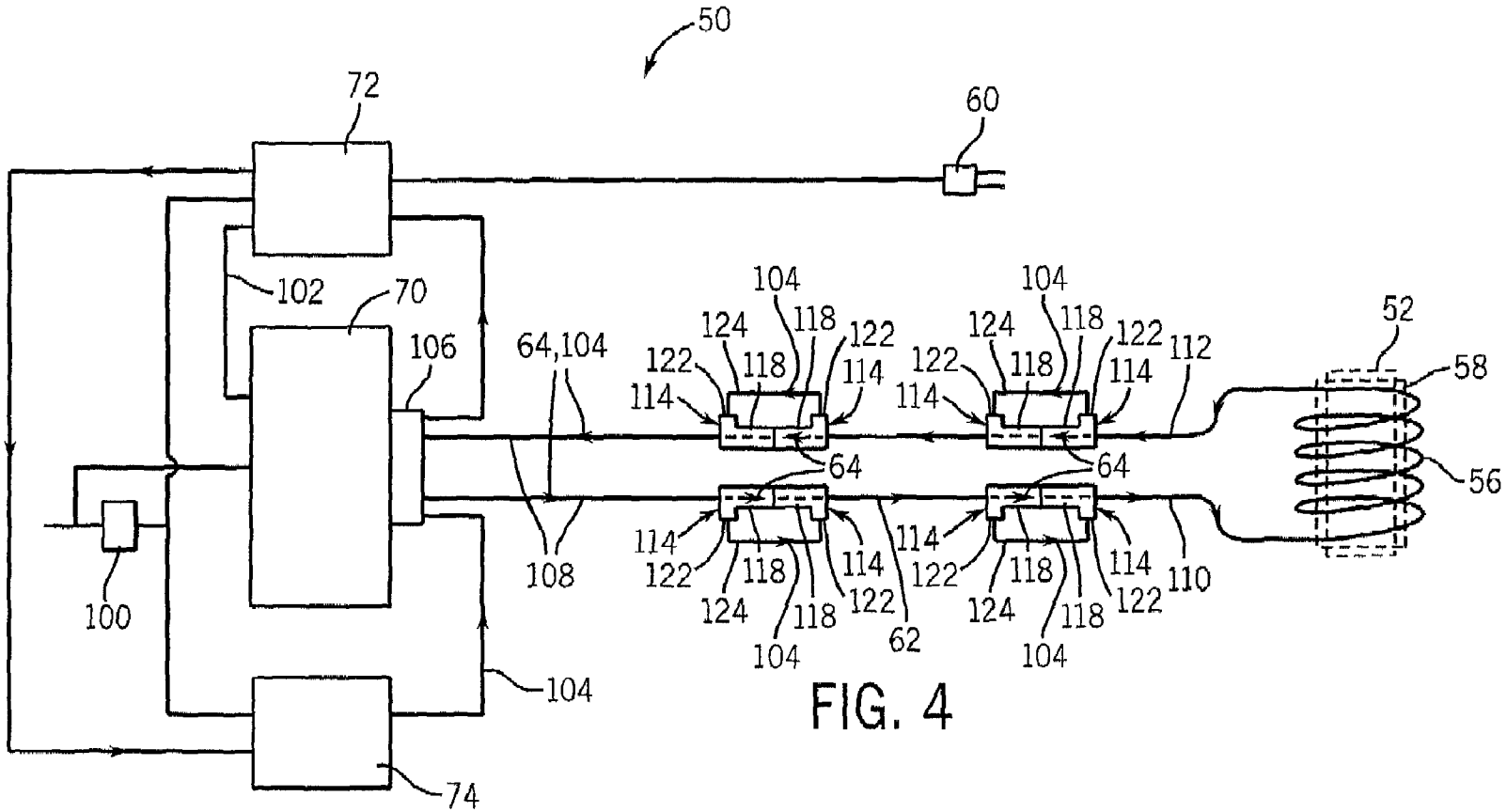
FIG. 4 is a schematic diagram of a system for inductively heating a workpiece, according to an exemplary embodiment of the present technique.

Referring generally to FIG. 4, an electrical and fluid schematic of the induction heating system 50 is illustrated. In the illustrated embodiment, 460 Volt, 3-phase AC input power is supplied to the power source 70 and to a step-down transformer 100. In the illustrated embodiment, the step-down transformer 100 produces a 115 Volt output applied to the fluid cooling unit 74 and to the controller 72. The step-down transformer 100 may be housed separately or within one of the other components of the system 50, such as the fluid cooling unit 74. A control cable 102 is used to electrically couple the controller 72 and the power source 70. As discussed above, the power source 70 provides a high-frequency AC power output, such as radio frequency AC signals, to the heating cable 56. In the illustrated embodiment, cooling fluid 104 from the cooling unit 74 flows to an output block 106. The cooling fluid 104 may be water, anti-freeze, etc. Additionally, the cooling fluid 104 may be provided with an anti-fungal or anti-bacterial solution. The cooling fluid 104 flows from the cooling unit 74 to the output block 106. Electrical current 64 from the power source 70 also is coupled to the output block 106.

In the illustrated embodiment, an output cable 108 is connected to the output block 106. The output cable 108 couples cooling fluid and electrical current to the extension cable 62. The extension cable 62, in turn, couples cooling fluid 104 and electrical current 64 to the fluid-cooled induction heating cable 56. In the illustrated embodiment, cooling fluid 104 flows from the output block 106 to the fluid-cooled induction heating cable 56 along a supply path 110 through the output cable 108 and the extension cable 62. The cooling fluid 104 returns to the output block 106 from the fluid-cooled induction heating cable 56 along a return path 112 through the extension cable 62 and the output cable 108. AC electric current 64 also flows along the supply and return paths. The AC electric current 64 produces a magnetic field that induces current, and thus heat, in the workpiece 52. Heat in the heating cable 56, produced either from the workpiece 52 or by the AC electrical current flowing through conductors in the heating cable 56, is carried away from the heating cable 56 by the cooling fluid 104. Additionally, the insulation blanket 58 forms a barrier to reduce the transfer of heat from the workpiece 52 to the heating cable 56.

Referring generally to FIGS. 1 and 4, in the illustrated embodiment, the fluid-cooled induction heating cable 56 has a connector assembly 114. The extension cable 62 also has a pair of connector assemblies 114. Each connector assembly 114 is adapted for mating engagement with another connector assembly 114. In the illustrated embodiment, each connector assembly separately couples electricity and cooling fluid. The connector assemblies are electrically coupled by connecting an electrical connector 118 in one connector assembly 114 with an electrical connector 118 in a second connector assembly 114. Each of the connector assemblies 114 also has a hydraulic fitting 122. The connector assemblies 114 are fluidicly coupled by routing a jumper 124 from the hydraulic fitting 122 in one connector assembly 114 to the hydraulic fitting 122 in a second connector assembly 114. Electrical current 64 flows through the electrical connectors 118 and fluid 104 flows through the hydraulic fittings 122 and jumper 124. In the illustrated embodiment, cooling fluid 104 from the heating cable 56 is then coupled to the controller 72. Cooling fluid flows from the controller 72 back to the cooling unit 74. The cooling unit 74 removes heat in the cooling fluid 104 from the heating cable 56. The cooled cooling fluid 104 is then supplied again to the heating cable 56.

Figure 5:
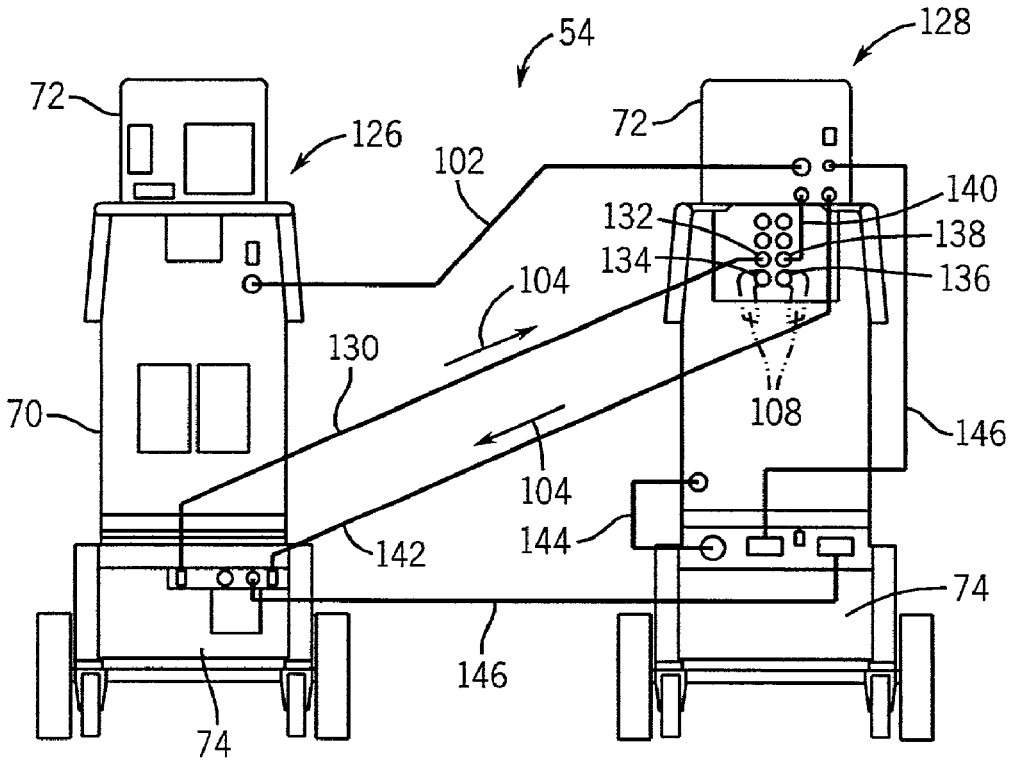
FIG. 5 is an elevational drawing illustrating the front and the rear of an induction heating system, according to an exemplary embodiment of the present technique.

Referring generally to FIG. 5, front and rear views of a power system 54 are illustrated. In the illustrated embodiment, the front side 126 of the power system 54 is shown on the left and the rear side 128 of the power system 54 is shown on the right. A first hose 130 is used to route fluid 104 from the front of the cooler 74 to a first terminal 132 of the output block 106 on the rear of the power source 70. The first terminal 132 is fluidicly coupled to a second terminal 134 of the output block 106. The output cable 108 is connected to the second terminal 134 and a third terminal 136. The second and third terminals are operable to couple both cooling fluid and electric current to the output cable 108. Supply fluid flows to the heating cable 56 through the second terminal 134 and returns from the heating cable 56 through the third terminal 136. The third terminal 136 is, in turn, fluidicly coupled to a fourth terminal 138. A second hose 140 is connected between the fourth terminal 138 and the controller 72. A third hose 142 is connected between the controller 72 and the cooling unit 74 to return the cooling fluid to the cooling unit 74, so that heat may be removed. An electrical jumper cable 144 is used to route 460 Volt, 3-phase power to the power source 70. Various electrical cables 146 are provided to couple 115 Volt power from the step-down transformer 100 to the controller 72 and the cooling unit 74.

Figure 6:
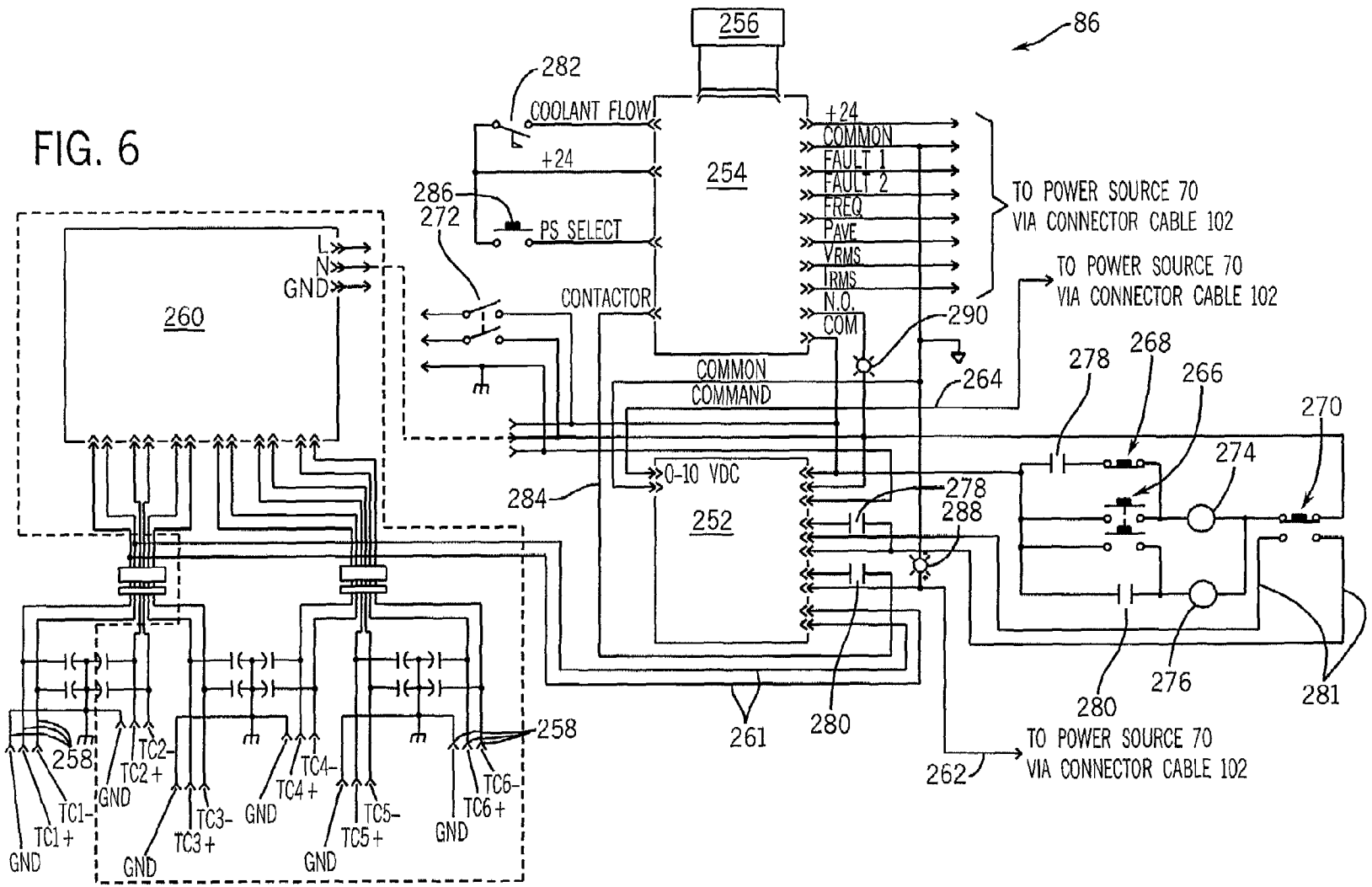
FIG. 6 is an electrical schematic of a controller, according to an exemplary embodiment of the present technique.

Referring generally to FIG. 6, the system 50 may be controlled automatically by the controller 72. The controller 72 has control circuitry 86 that enables the system 50 to receive programming instructions and control the operation of the power source 70 in response to the programming instructions and data received from the power source 70 and temperature feedback device 60. In the illustrated embodiment, the control circuitry 86 comprises a control unit 252, an I/O unit 254, a parameter display 256, and a plurality of electrical switches. Connection jacks 258 are provided to enable the temperature feedback device 60 to be electrically coupled to the controller 72 and to a data recorder 260. At least one temperature feedback device 60 is coupled through the jacks 258 to the control unit 252 via a pair of conductors 261 so as to provide a DC voltage representative of workpiece temperature to the control unit 252. Additional jacks 258 are provided to enable a plurality of temperature feedback devices to be coupled to the data recorder 260. The data recorder 260 may be adapted to record operating parameters, as well. Preferably, the data recorder 260 is a digital device operable to store and transmit data electronically. Alternatively, the controller 72 may have a paper recorder, or no recorder at all. The control unit 252 is operable to receive programming instructions to direct the system 50 to produce a desired temperature profile in a workpiece 52. During operation, the control unit 252 receives temperature data from a temperature feedback device 60 and controls the application of power to the workpiece 52 to achieve a desired workpiece temperature, a desired rate of temperature increase in the workpiece, etc.

In addition, the control unit 252 is pre-programmed with operational control instructions that control how the control unit 252 responds to the programming instructions. Accordingly, the control unit 252 may comprise a processor and memory, such as RAM. There are a number of control schemes that may be used to control the application of heat to the workpiece. For example, an on-off controller maintains a constant supply of power to the workpiece until the desired temperature is reached, then the controller turns off. However, this can result in temperature overshoots in which the workpiece is heated to a much higher temperature than is desired. In proportional control, the controller controls power in proportion to the temperature difference between the desired temperature and the actual temperature of the workpiece. A proportional controller will reduce power as the workpiece temperature approaches the desired temperature. The magnitude of a temperature overshoot is lessened with proportional control in comparison to an on-off controller. However, the time that it takes for the workpiece to achieve the desired temperature is increased. Other types of control schemes include proportional-integral (PI) control and proportional-derivative (PD) control. Preferably, the control unit 252 is programmed as a proportional-integral-derivative (PID) controller. However, the control unit also may be programmed with PI, PD, or other type of control scheme. The integral term provides a positive feedback to increase the output of the system near the desired temperature. The derivative term looks at the rate of change of the workpiece temperature and adjusts the output based on the rate of change to prevent overshoot.

The control unit 252 provides two output signals to the power source 70 via the control cable 102. The power source 70 receives the two signals and operates in response to the two signals. The first signal is a contact closure signal 262 that energizes contacts in the power source 70 to enable the power source 70 to apply power to the induction heating cable 56. The second signal is a command signal 264 that establishes the percentage of available power for the power source 70 to apply to the induction heating cable 56. The voltage of the command signal 264 is proportional to the amount of available power that is to be applied. The greater the voltage of the command signal 264, the greater the amount of power supplied by the power source. In this embodiment, a variable voltage was used. However, a variable current may also be used to control the amount of power supplied by the power source 70.

Figure 7:
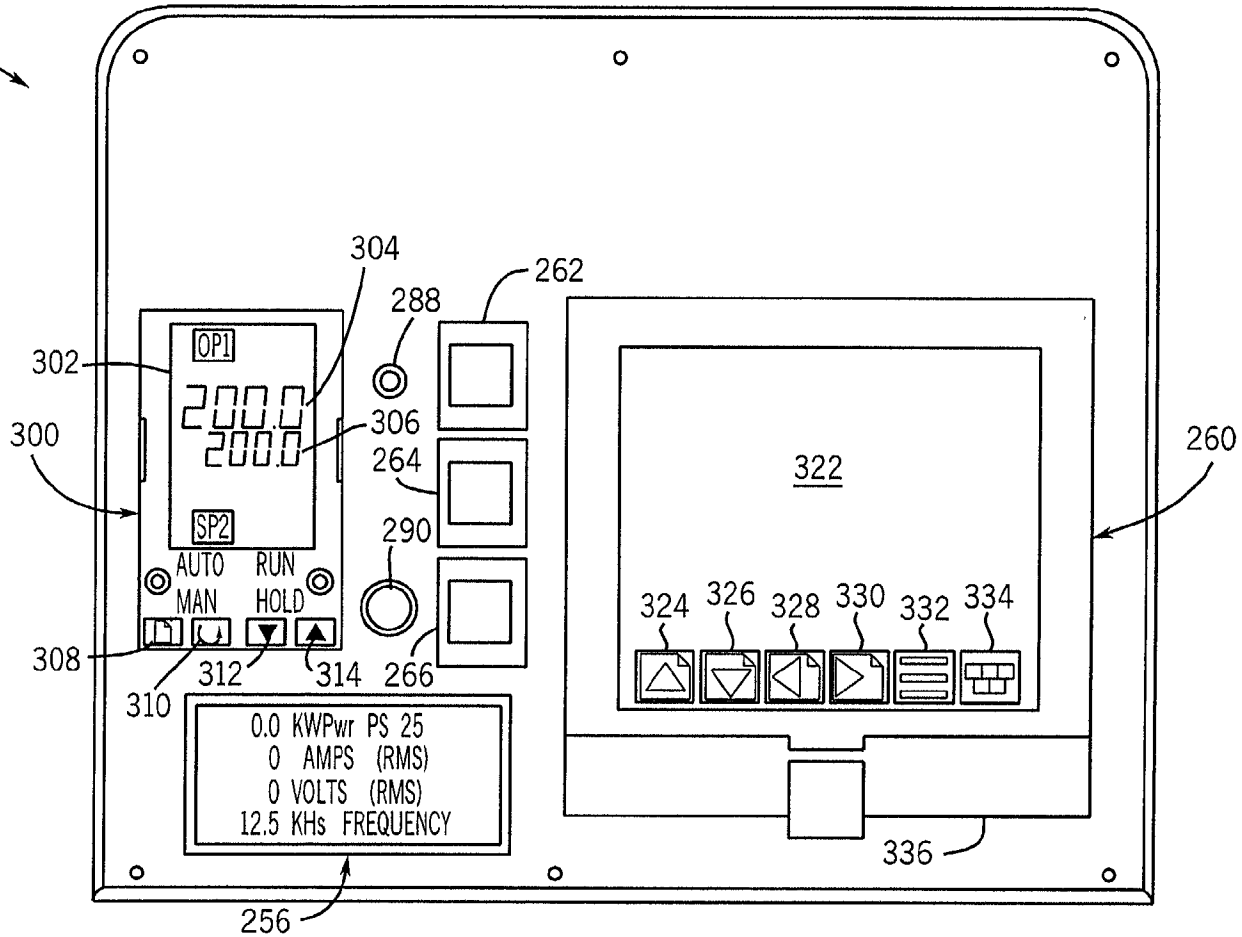
FIG. 7 is a front elevational view of a controller, according to an exemplary embodiment of the present technique.

Referring generally to FIGS. 6 and 7, the electrical switches that provide signals to the control unit 252 include a run button 266, a hold button 268, and a stop button 270. In addition, a power switch 272 is provided to control the supply of power to the controller 72. The run button 266 directs the control unit 252 to begin operating in accordance with the programming instructions. When the run button 266 is closed to begin the induction heating process, a first relay 274 and a second relay 276 are energized. When energized, the first relay closes first contacts 278 and the second relay 276 closes second contacts 280. The relays and contacts maintain signals coupled to the control unit 252 after the run button 266 is released.

The hold button 268 stops the timing feature of the controller 72 and directs the control unit 252 to maintain the workpiece at the current target temperature. The hold button 268 enables the system 50 to continue operating while new programming instructions are provided to the controller 72.

When operated, the hold button 268 opens, removing power from the first relay 274 and opening the first contacts 278. This directs the controller to remain at the current point in the heating cycle so that the heating cycle begins right where it was in the cycle when operation returns to normal. Additionally, the second relay 276 remains energized, maintaining the second contacts 280 closed to allow the power supply to continue to provide power to the induction heating coil 56. The run button 266 is re-operated to redirect the control unit 252 to resume operation in accordance with the programming instructions. When re-operated, the first relay 274 is re-energized and the first contacts 278 are closed. The stop button 270 directs the control unit 252 to stop heating operations. As the stop button 270 is operated, power is removed from both the first and second relays, opening the first and second contacts and removing power from the power source contactors. In the illustrated embodiment, a circuit 281 is completed when the stop button 270 is fully depressed. The circuit 281 directs the control unit 252 to be reset to the first segment of the heating cycle.

The I/O unit 254 receives data from the power source 70 and couples it to the control unit 252 and/or the parameter display 256. The data may be a fault condition recognized by the power source 70 or operating parameters of the power source 70, such as voltage, current, frequency, and the power of the signal being provided by the power source 70 to the flexible inductive heating cable 56. The I/O unit 254 receives the data from the power source 70 via the control cable 102.

In the illustrated embodiment, the I/O unit 254 also receives an input from a flow switch 282. The flow switch 282 is closed when there is adequate cooling flow returning from the flexible inductive heating cable 56. When fluid flow through the flow switch 282 drops below the required flow rate, flow switch 282 opens and the I/O unit 254 provides a signal 284 to the control unit 252 to direct the power source 70 to discontinue supplying power to the induction heating cable 56. Additionally, the flow switch 282 is located downstream, rather than upstream, of the flexible inductive heating cable 56 so that any problems with coolant flow, such as a leak in the flexible inductive heating cable 56, are detected more quickly.

A power source selector switch 286 is provided to enable a user to select the appropriate scale for display of power on the parameter display for the power source coupled to the controller 72. The power selector switch 286 enables a user to thereby set the controller for the specific power source controlled by the controller 72. For example, the controller 72 may be used to control a variety of different powers having the same voltage range corresponding to the percentage output of the power source. Thus, a 5 volt output from a 50 KW power source would represent 25 KW while a 5 volt output from a 20 KW power source would represent only 10 KW. The power source selector switch 286 enables a user to toggle through a selection of power source maximum output powers, 5 KW, 25 KW, 50 KW, etc., corresponding to the maximum output power of the power source 72.

The controller 72 also has a plurality of visual indicators to provide a user with information. One indicator is a heating light 288 to indicate when power source output contacts are closed to enable current to flow from the power source 70 to the induction heating cable 56. Another indicator is a fault light 290 to indicate to a user when a problem exists. The fault light may be lit when there is an actual fault, such as a loss of coolant flow, or when an improper power source 70 condition exists, such as a power or current limit or fault.

Referring generally to FIG. 7, the control unit 252 is programmed from the exterior of the controller 72. In addition, the exterior of the controller 72 has a number of operators and indicators that enable a user to operate the system 50. For example, the control unit 252 has a temperature controller 300 that enables a user to input programming instructions to the control unit 252. The illustrated temperature controller 300 has a digital display 302 that is operable to display programming instructions that may be programmed into the system 50. In the illustrated embodiment, the digital display 302 is operable to display both the actual workpiece temperature 304 and a target temperature 306 that has been programmed into the system 50. The digital display 302 may also display other temperature information, such as the segment type/function and the programmed rate of temperature change. The illustrated temperature controller 300 has a page forward button 308, a scroll button 310, a down button 312, and an up button 314 that are used to program and operate the system 50. To program the control unit 252, the page forward button 308 is operated until a programming list is displayed.

Each heating operation for each segment of a temperature profile may be programmed into the controller 72 from the programming list. The system 50 is operable to perform at least four basic types of heating operations: step, dwell, ramp rate, and ramp time. A step operation is a heating operation where the desired temperature of the workpiece changes in a step increment from a current value to a new value. The system 50 will automatically begin operating to change the workpiece temperature to the new value. A dwell operation is a heating operation wherein the system automatically operates to maintain the workpiece at a desired temperature for a specified period of time. A ramp time operation is a heating operation wherein the system operates to change the workpiece temperature linearly from a current value to a new value over a defined period of time. The ramp rate operation is a heating operation wherein the system operates to ramp the workpiece temperature linearly from a current temperature to a new temperature at a defined rate of change. The specific type of heating operation may be selected from the programming list using the scroll button 310. The up button 314 and the down button 312 enable a user to input specific desired values to the controller 72.

Also present on the exterior of the controller 72 is the parameter display 256. The parameter display 256 provides a user with system operating parameter data received by the I/O unit 254. For example, the illustrated parameter display 256 is operable to provide a user with the power available from the power source 70 and the power that is currently being provided by the power source 70. The parameter display 256 also is operable to provide a user with the values of the AC output current and the AC output voltage of the power source 70. The parameter display 256 also is operable to provide a user with the frequency of the AC output current to the flexible inductive heating cable 56. Additionally, the display 256 is operable to provide messages indicating, for example, a coolant flow error or power source limit error.

Additionally, the digital recorder 260 has a touch-screen display 322 that is present on the exterior of the controller 72. The illustrated touch-screen display 322 is operable to display temperature information from one or more temperature feedback devices 60. For example, the touch-screen display 322 is operable to visually graph the temperature of the workpiece over time. The touch-screen display 322 may be operable to display system operating parameter information, as well. The touch-screen display 322 is operable to display a number of icons that are activated by touching the touch-screen display 322. The illustrated touch-screen display 322 has a page up icon 324, a page down icon 326, a left icon 328, a right icon 330, an option icon 332, and a root icon 334. The touch-screen display 322 may have additional or alternative icons. The name of the system user who performed the inductive heating operation may be added for display on the touch-screen display 322. Other information, such as a description of the workpiece 52, may also be added for display. Additionally, the illustrated data recorder 260 has a disc drive 336. The disc drive 336 is operable to receive data stored in the data recorder 260 for transfer to a computer system. In addition, or alternatively, to the disc drive 336, the recorder 260 may have the capability for networking, such as a RJ45 network connection, and/or a PCMCIA card.

Figure 8:
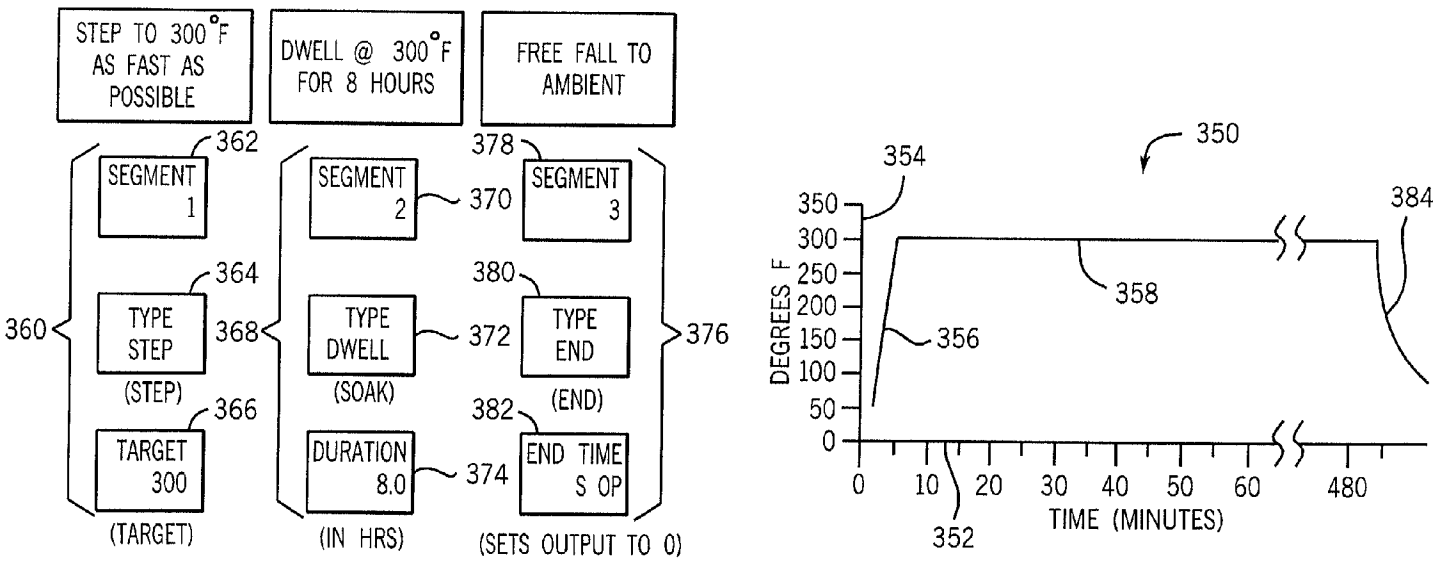
FIG. 8 is a desired temperature profile of a workpiece to preheat the workpiece for welding.

Referring generally to FIG. 8, an example of an induction heating operation that may be programmed into the controller 72 is illustrated. FIG. 8 illustrates a typical temperature profile 350 for pre-heating a workpiece for welding. In FIG. 8, the x-axis 352 represents time in minutes and the y-axis 354 represents temperature in degrees Fahrenheit. The illustrated pre-heating temperature profile 350 has a first segment 356 and a second segment 358. During the first segment 356, it is desired that the temperature of the workpiece 52 rise from its present temperature to 300° F. During the second segment 358, it is desired that the workpiece 52 remain at 300° F. for 8 hours.

To program the system 50, the temperature profile 350 is broken up into segments. To produce the first segment 356 of the temperature profile 350, a first series 360 of programming instructions are provided to the temperature controller 300. The page forward button 308 is operated until the programming list is displayed. The segment function is selected from the programming list and set for a first segment, as represented by icon 362 displayed on the digital display 302. The step function is then selected from the programming list, as represented by icon 364 displayed on the digital display 302. The up button 314 and/or the down button 312 are operated to set the desired temperature for the step function to 300° F., as represented by icon 366 displayed on the digital display 302.

A second series 368 of programming instructions are provided to the temperature controller 300 to produce the second segment 358 of the temperature profile 350 in the workpiece. The segment function is selected from the programming list and set for a second segment, as represented by icon 370 displayed on the digital display 302. The dwell function is then selected from the programming list, as represented by icon 372. The duration of the dwell function is then set for 8 hours, as represented by icon 374 displayed on the digital display 302. To end the pre-heating operation, a third series 376 of programming instructions are provided to the temperature controller. The segment function is selected from the programming list and set for a third segment, as represented by icon 378 displayed on the digital display 302. The end heating function is then selected from the programming list, as represented by icon 380 displayed on the digital display 302. The output power of the system 50 is set to 0, as represented by icon 382 displayed on the digital display 302. The temperature of the workpiece 52 will fall to ambient temperature, as represented by the third segment 384 of the temperature profile 350.

To start the heating operation, the run button 266 is operated. The power source will energize and the heat on light 288 will illuminate. The power source parameters will be displayed on the parameter display 256 and the temperature information from the temperature feedback device 60 is displayed on the temperature controller 300. The control unit 252 will control operation of the power source 70 to heat the workpiece according to the programmed instructions. In the illustrated embodiment, the temperature controller 300 will flash "hold" until the measured temperature climbs to within a preset temperature difference, the hold back temperature, of the target temperature. The hold back temperature may be programmed into the control unit 252, as well.

To adjust the temperature profile during the heating cycle, the hold button 268 is operated. The page button is operated to display the program list. The scroll button then is operated to select the desired parameter for changing. The up and down buttons are operated to change the value of the parameter. Once the value of the parameter has been changed, the page buttons are operated to return to the parameter screen. The run button 266 then is operated to resume the heating program. The stop button 270 is operated when the heating cycle has been completed or to abort the heating process during the heating cycle. The controller 72 will reset to the first segment and the power source contactor relay will open.

Figure 9:
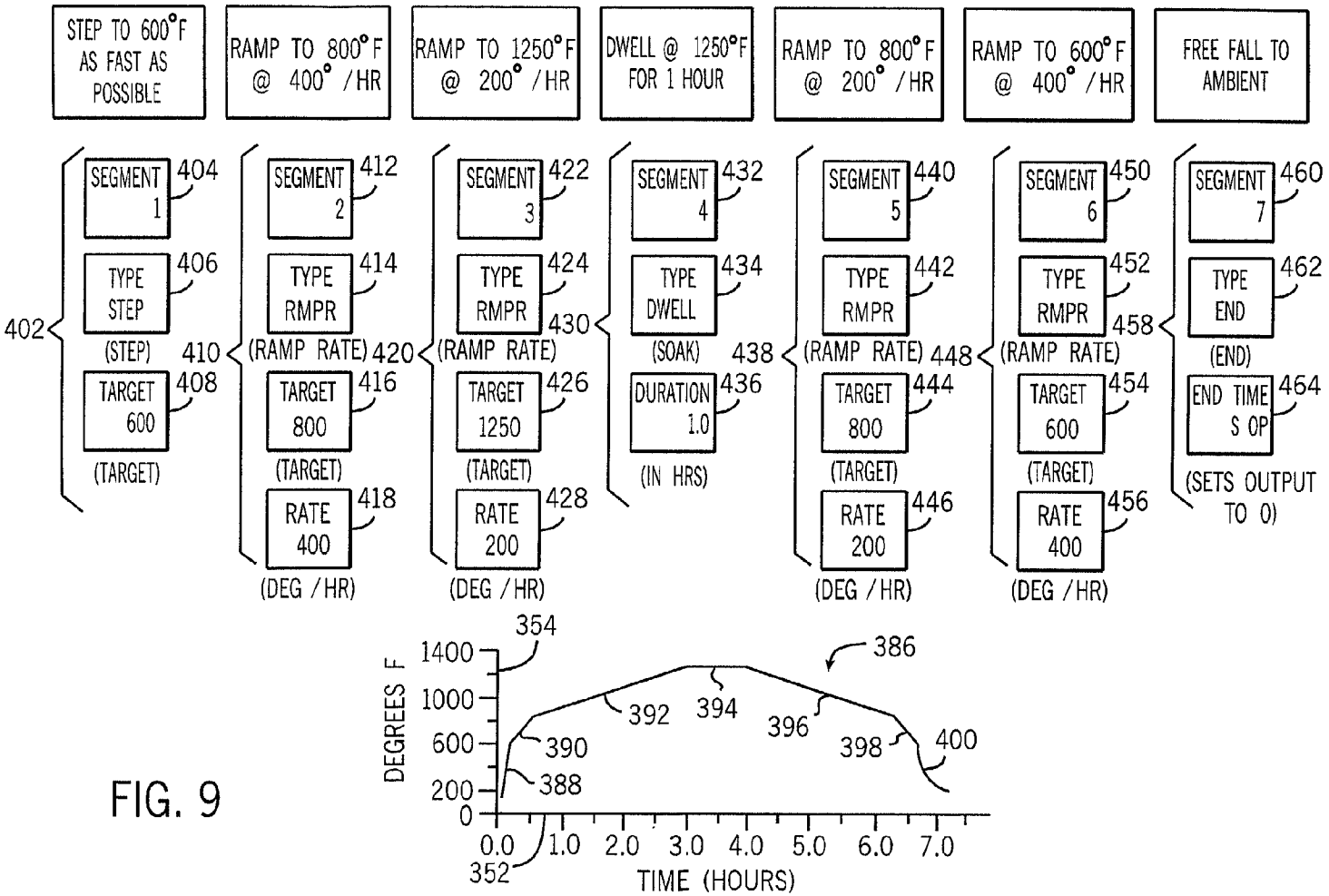
FIG. 9 is a desired temperature profile of a workpiece to relieve stress from the workpiece after welding.

Referring generally to FIG. 9, another example of an induction heating operation that may be performed with the induction heating system 50 is illustrated. FIG. 9 illustrates an exemplary temperature profile 386 for relieving stress in a workpiece 52, e.g., to relieve stress from a weld joint after welding. FIG. 9 also illustrates the series of programming instructions that may be entered into the temperature controller 300 beforehand to automatically produce the illustrated stress-relief temperature profile 386. The illustrated stress-relieving temperature profile 386 has a first segment 388, a second segment 390, a third segment 392, a fourth segment 394, a fifth segment 396, a sixth segment 398, and a seventh segment 400.

During the first segment 388 of the illustrated temperature profile 386, it is desired to raise the temperature of the workpiece 52 from its present temperature to a temperature of 600° F. During the second segment 358, it is desired that the workpiece temperature rise to 800° F. at a rate of 400° F. During the third segment 392, it is desired that the workpiece temperature rise to 1250° F. at a rate of 200° F. During the fourth segment 394, it is desired that the temperature of the workpiece 52 remain at 1350° F. for 1 hour. During the fifth segment 396, it is desired that the temperature of the workpiece decrease to 800° F. at a rate of 200° F. per hour. During the sixth segment 398, it is desired that the temperature of the workpiece 52 decrease to 600° F. at a rate of 400° F. per hour. During the seventh segment 400, it is desired that heating operation cease and the workpiece cool to ambient temperature.

A first series 402 of programming instructions are provided to the temperature controller 300 to produce the first segment 388 of the stress-relief temperature profile 386. The segment function is selected from the programming list and set for a first segment, as represented by icon 404 displayed on the digital display 302. The step function is then selected, as represented by icon 406. The up button 314 and/or the down button 312 are operated to set the desired temperature for the step function to 600° F., as represented by icon 408.

A second series 410 of programming instructions are provided to the temperature controller 300 to produce the second segment 390 of the stress-relieving temperature profile 386. The segment function is selected from the programming list and set for a second segment, as represented by icon 412. The ramp rate function is then selected from the programming list, as represented by icon 414. The desired temperature is then set on the temperature controller 300 to the desired temperature of 800° F., as represented by icon 416. The desired rate of temperature change of 400° F. per hour is then set on the temperature controller 300, as represented by icon 418.

A third series 420 of programming instructions are provided to the temperature controller 300 to produce the third segment 392 of the stress-relieving temperature profile 386. The segment function is selected from the programming list and set for a third segment, as represented by icon 422 displayed on the digital display 302. The ramp rate function is then selected, as represented by icon 424. The target temperature of 1250° F. is then set, as represented by icon 426. The desired rate of temperature change is set to 200° F./hr, as represented by icon 428.

A fourth set 430 of programming instructions are preset into the temperature controller 300 to produce the fourth segment 394 of the temperature profile 386. The segment function for the fourth segment is selected, as represented by icon 432. The dwell function is selected from the programming list, as represented by icon 434. The duration is then set for 1 hour, as represented by icon 436.

A fifth series 438 of programming instructions are provided to the temperature controller 300 to produce the fifth segment 396 of the stress-relieving temperature profile 386. The segment function is selected from the programming list and set for a fifth segment, as represented by icon 440. The ramp rate function is then selected from the programming list, as represented by icon 442. The desired temperature is then set on the temperature controller 300 to the desired temperature of 800° F., as represented by icon 444. The desired rate of temperature change of 200° F. per hour is then set on the temperature controller 300, as represented by icon 446.

A sixth series 448 of programming instructions are provided to the temperature controller 300 to produce the sixth segment 398 of the stress-relieving temperature profile 386. The segment function is selected from the programming list and set for a sixth segment, as represented by icon 450. The ramp rate function is then selected from the programming list, as represented by icon 452. The desired temperature is then set on the temperature controller 300 to the desired temperature of 600° F., as represented by icon 454. The desired rate of temperature change of 400° F. per hour is then set on the temperature controller 300, as represented by icon 456.

A seventh series 458 of programming instructions are provided to the temperature controller to end the stress-relieving heating operation. The segment function is selected from the programming list and set for a seventh segment, as represented by icon 460. The end heating function is then selected from the programming list, as represented by icon 462. The output power of the system 50 is set to 0, as represented by icon 464. Once the programming instructions are provided and the conditions for operating the system 50 are established, the run button 266 may be operated to direct the system to automatically produce the programmed temperature profile. As discussed above, the data recorder 260 is operable to store temperature profile data received from each of the temperature feedback devices 60. The data may be stored in the recorder and transferred to a disc (not shown) in the disc drive 336. The disc from the disc drive 336 may then be transferred to a computer system, such as a personal computer. The computer system may be used to analyze the data.

Figure 10:
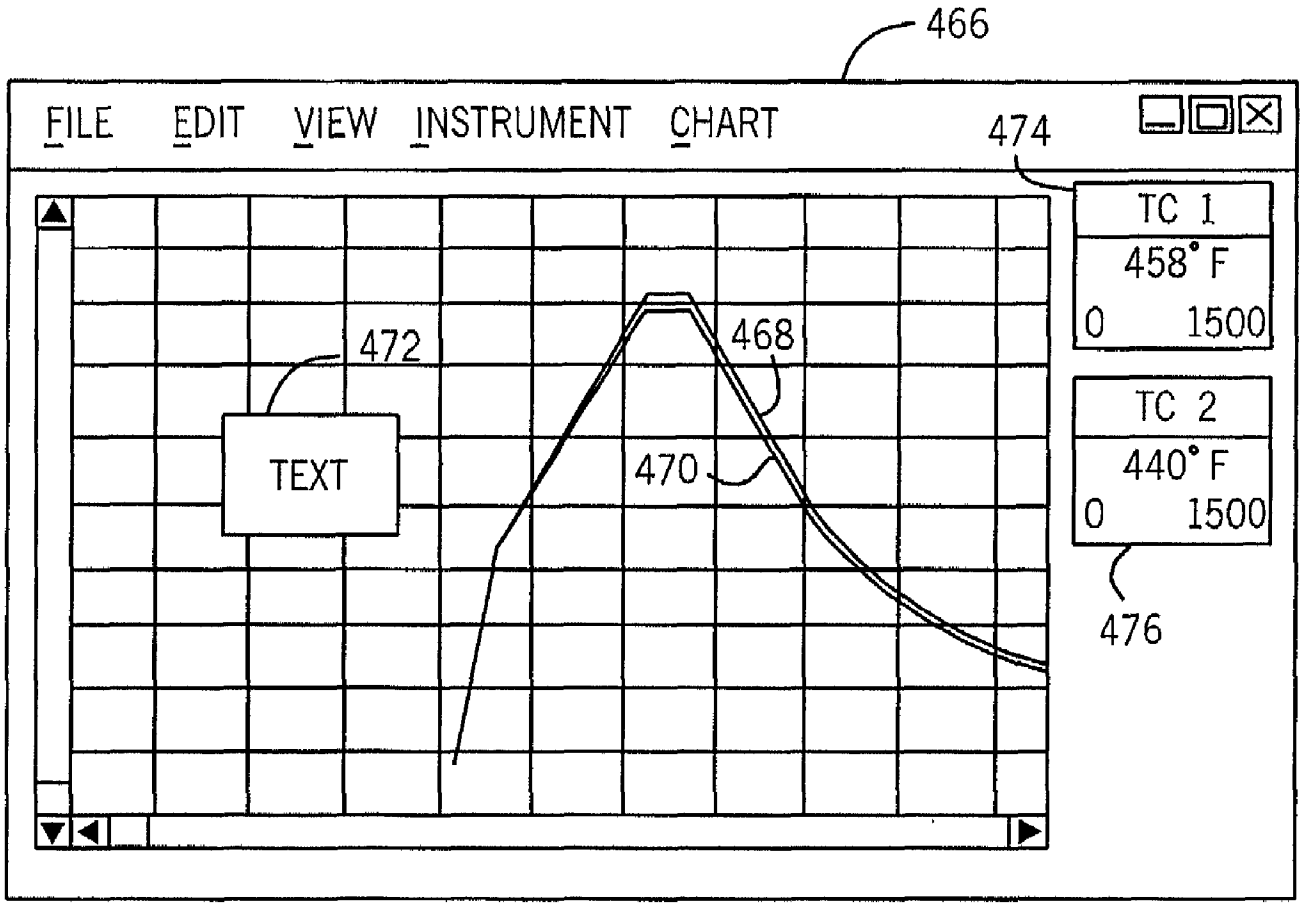
FIG. 10 is a representation of a graphical user interface for a computer system operable to display temperature data recorded by a recording device in the controller.

As illustrated in FIG. 10, a computer system may be used to provide the data in a graphical user interface 466. In the illustrated embodiment, a first graphical representation 468 of the temperature information received from a first temperature feedback device 60 and a second graphical representation 470 of the temperature information received from a second temperature feedback device 60 are displayed. Additionally, the temperature of the workpiece 52 at a specific time may be displayed numerically. For example, a cursor may be used to select a specific time on the graphical representations. In the illustrated embodiment, the actual temperature data received from the first temperature device at the selected time is displayed in a first box 474 and the actual temperature data received from the second temperature feedback device at the selected time is displayed in a second box 476.

It will be understood that the foregoing description is of preferred exemplary embodiments of this invention, and that the invention is not limited to the specific forms shown. For example, the system is not limited to inductively heating a workpiece according to the programming instructions or temperature profiles discussed above. Additionally, the system may be programmed to automatically perform a series of inductive heating operations or may be programmed to perform a single heating operation. These and other modifications may be made in the design and arrangement of the elements without departing from the scope of the invention as expressed in the appended claims.

What is claimed is:

1. An induction heating system, comprising:

a power source operable to produce an alternating current to inductively heat a workpiece;

a controller operable to control operation of the power source, wherein the controller is operable to receive programming instructions to selectively increase and decrease workpiece temperature at a desired rate of change and to automatically control operation of the power source to provide inductive heat to the workpiece to selectively increase and decrease the workpiece temperature at the desired rate of change; and a temperature feedback device operable to provide the controller with an electrical signal representative of the workpiece temperature.

2. The system as recited in claim 1, comprising a data recorder operable to record workpiece temperature data.

3. The system as recited in claim 1, wherein the power source is operable to provide sufficient power to enable the system to perform stress relief of a workpiece.

4. The system as recited in claim 3, wherein the controller is programmable to direct the system to inductively heat a workpiece to perform the stress relief of the workpiece automatically.

5. The system as recited in claim 1, wherein the controller is operable to control operation of the power source to lower the workpiece temperature at a desired rate of temperature decrease automatically.

6. The system as recited in claim 1, wherein the controller enables a user to establish the desired rate of temperature change by providing a specific desired rate of temperature change.

7. The system as recited in claim 1, wherein the controller enables a user to establish the desired rate of temperature change by providing a desired time period for the workpiece temperature to change and a specific temperature change.

8. The system as recited in claim 1, wherein the controller is operable to control the power source to maintain workpiece temperature at a desired temperature for a desired period of time.

9. The system as recited in claim 8, wherein the controller is operable to change workpiece temperature to a desired workpiece temperature.

10. The system as recited in claim 1, wherein the controller utilizes Proportional-Integral-Derivative (PID) control.

11. The system as recited in claim 1, comprising a data recorder operable to record workpiece temperature data received from at least one temperature feedback device.

12. The system as recited in claim 1, wherein the controller utilizes Proportional-Integral (PI) control.

13. An induction heating system, comprising:

an induction heating power source; a temperature feedback device operable to provide the system with workpiece temperature data; and a controller operable to control operation of the induction heating power source to increase workpiece temperature to an elevated temperature and to reduce workpiece temperature from the elevated temperature to a lower temperature at a desired rate of temperature decrease automatically in response to programming instructions and the workpiece temperature data.

14. The system as recited in claim 13, comprising a data recorder, wherein the data recorder records the workpiece temperature data digitally.

15. The system as recited in claim 14, comprising a disc drive, wherein the data recorder is operable to transfer data to the disc drive for storage on a digital recording media.

16. The system as recited in claim 13, comprising a plurality of temperature feedback devices, wherein the data recorder is operable to record workpiece temperature data from each of the plurality of temperature feedback devices.

17. The system as recited in claim 16, wherein the plurality of temperature feedback devices are thermocouples.

18. The system as recited in claim 13, comprising a PCMIA module operable to transfer data from the recorder.

19. The system as recited in claim 13, comprising a networking module operable to couple the recorder to a network.

20. A system controller for an induction heating system, comprising:

a control unit operable to control operation of an inductive heating power source automatically in response to programming instructions; and a user interface to enable a user to provide the programming instructions to the control unit, wherein the user interface enables a user to establish a sequence of inductive heating operations to be performed automatically by the induction heating system from a selection of inductive heating operations to control the rate of temperature change in a workpiece.

21. The system controller as recited in claim 20, wherein the desired rate of temperature change is a decrease in workpiece temperature.

22. The system controller as recited in claim 20, wherein one of the inductive heating operations in the selection of inductive heating operations directs the system to maintain workpiece temperature at a desired temperature for a desired period of time.

23. The system controller as recited in claim 20, wherein one of the inductive heating operations in the selection of inductive heating operations directs the system to change workpiece temperature from a current workpiece temperature to a new workpiece temperature.

24. The system controller as recited in claim 20, wherein the system controller is operable to store the sequence of inductive heating operations to be performed automatically by the induction heating system for use in a subsequent inductive heating operation.

25. A system for heating a workpiece, comprising:

a power source electrically coupleable to an induction heating device; and a system controller, comprising:

a control unit operable to control operation of an inductive heating power source automatically in response to programming instructions; and a user interface to enable a user to provide the programming instructions to the control unit, wherein the user interface enables a user to establish a sequence of inductive heating operations from a selection of inductive heating operations that may be performed automatically by the induction heating system to control the rate of temperature change in a workpiece.

26. The system as recited in claim 25, wherein the power source and system controller are portable.

27. A system for heating a workpiece, comprising:

an induction heating device;

a power source operable to transmit power to the induction heating device;

a controller operable to control operation of the power source automatically to heat the workpiece according to a desired workpiece temperature profile, wherein the controller is operable to heat the workpiece at a first rate of temperature increase during a first portion of the workpiece temperature profile and to heat the workpiece at a second rate of temperature increase during a second portion of the workpiece temperature profile, the second rate of temperature increase being different than the first rate of temperature increase.

28. The system as recited in claim 26, wherein the controller and a data recorder are housed in a common enclosure.

* * * * *